US009480119B2

(12) United States Patent
Mason et al.

(10) Patent No.: US 9,480,119 B2
(45) Date of Patent: Oct. 25, 2016

(54) METHOD AND APPARATUS FOR SELECTIVE ILLUMINATION OF AN ILLUMINATED TEXTILE BASED ON PHYSICAL CONTEXT

(71) Applicant: KONINKLIJKE PHILIPS N.V., Eindhoven (NL)

(72) Inventors: Jonathan David Mason, Waalre (NL); Dzmitry Viktorovich Aliakseyeu, Eindhoven (NL); Berent Willem Meerbeek, Eindhoven (NL); Sanae Chraibi, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/906,980

(22) PCT Filed: Jul. 15, 2014

(86) PCT No.: PCT/IB2014/063105

§ 371 (c)(1),
(2) Date: Jan. 22, 2016

(87) PCT Pub. No.: WO2015/011605

PCT Pub. Date: Jan. 29, 2015

(65) Prior Publication Data

US 2016/0174321 A1 Jun. 16, 2016

Related U.S. Application Data

(60) Provisional application No. 61/856,836, filed on Jul. 22, 2013.

(51) Int. Cl.

| | |
|---|---|
| ***F21V 21/08*** | (2006.01) |
| ***H05B 33/08*** | (2006.01) |
| ***H05B 37/02*** | (2006.01) |

(52) U.S. Cl.
CPC ..... *H05B 33/0854* (2013.01); *H05B 37/0227* (2013.01)

(58) Field of Classification Search
CPC ..... F21S 8/04; F21V 21/08
USPC ..... 362/127, 145, 806, 103
See application file for complete search history.

(56) References Cited

U.S. PATENT DOCUMENTS

| | | | |
|---|---|---|---|
| 5,023,709 | A | 6/1991 | Kita et al. |
| 6,016,038 | A | 1/2000 | Mueller et al. |

(Continued)

FOREIGN PATENT DOCUMENTS

| | | | |
|---|---|---|---|
| GB | 2377280 | A | 8/2003 |
| WO | 2009013599 | A1 | 1/2009 |

(Continued)

OTHER PUBLICATIONS

Buechley, Leah et al, "The Lilypad Arduino: Toward Wearable Engineering for Everyone," Wearable Computing, Pervasive Computing, Published by the IEEE 2008 (4 Pages).

(Continued)

*Primary Examiner* — Thuy Vinh Tran
(74) *Attorney, Agent, or Firm* — Meenakshy Chakravorty

(57) ABSTRACT

Various methods and apparatus disclosed herein relate to selectively illuminating an illuminated textile (100) based on a physical context of the illuminated textile. For example, in some embodiments, data from one or more sensors (104) embedded in or otherwise associated with an illuminated textile may be utilized by a controller (108) to implement lighting property adjustments for one or more selected light sources (106) embedded in or associated with the textile, based on the data. The data may be indicative of a physical context of the illuminated textile.

20 Claims, 6 Drawing Sheets

(56) References Cited

U.S. PATENT DOCUMENTS

| | | | | |
|---|---|---|---|---|
| 6,211,626 | B1 | 4/2001 | Lys et al. | |
| 7,697,925 | B1 | 4/2010 | Wilson et al. | |
| 8,395,317 | B2 * | 3/2013 | Bhattacharya | D03D 1/0088 313/491 |
| 8,417,120 | B2 * | 4/2013 | Kim | H04B 13/00 362/551 |
| 2005/0207172 | A1 | 9/2005 | Orth | |
| 2006/0147678 | A1 | 7/2006 | Marmaropoulos et al. | |
| 2008/0198585 | A1 | 8/2008 | Tait | |
| 2008/0200085 | A1 | 8/2008 | Van Bruggen et al. | |
| 2011/0069974 | A1 | 3/2011 | Kim et al. | |
| 2011/0285854 | A1 | 11/2011 | Laduke et al. | |
| 2014/0340877 | A1 * | 11/2014 | Nelson | F21V 33/0008 362/103 |
| 2014/0340902 | A1 * | 11/2014 | Nelson | F21V 33/0008 362/249.06 |

FOREIGN PATENT DOCUMENTS

| | | | |
|---|---|---|---|
| WO | 2011100441 | A1 | 8/2011 |
| WO | 2011114263 | A2 | 9/2011 |

OTHER PUBLICATIONS

Buechley, Leah, "A Construction Kit for Electronic Textiles," Craft Technology Group, University of Colorado at Boulder, Dept. of Computer Science, IEEE 2006 (8 Pages).

Philips Research Technology Magazine, "Password," Issue 28, Oct. 2006 (17 Pages).

Sensing Tex, Luminous Tex, "Light Up Your Creations," www.sensingtex.com, Apr. 2013 (8 Pages).

Sensing Tex, Pressure Sensing Tex, "The New Generation of Pressure Measurement Sensors," www.sensingtex.com, Apr. 2013 (2 Pages).

* cited by examiner

METHOD AND APPARATUS FOR SELECTIVE ILLUMINATION OF AN ILLUMINATED TEXTILE BASED ON PHYSICAL CONTEXT

CROSS-REFERENCE TO PRIOR APPLICATIONS

This application is the U.S. National Phase application under 35 U.S.C. §371 of International Application No. PCT/IB2014/063105, filed on Jul. 15, 2014, which claims the benefit of U.S. Provisional Patent Application No. 61/856,836, filed on Jul. 22, 2013. These applications are hereby incorporated by reference herein.

TECHNICAL FIELD

The present invention is directed generally to lighting control. More particularly, various inventive methods and apparatus disclosed herein relate to selective illumination of an illuminated textile based on physical context.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Light sources such as LEDs may be integrated with textiles to create so-called "illuminated textiles." For instance, light sources may be coupled into a textile and out again using, e.g., optic fibers. As another example, light sources such as LEDs may be embedded into a textile using conductive thread. In some instances, in addition to or instead of integrating light sources into the textile, light may be projected onto a textile, e.g., as visible light or ultraviolet light (e.g., to illuminate a fluorescent textile).

Illuminated textiles may be used for various purposes. In an architectural context such as in a retail space or an office, illuminated textiles may be used as curtains, wall or ceiling coverings, spaced dividers, furniture, carpets, and so forth. Illuminated textiles may also be used in other domains, including clothing, car interiors, etc.

It may be desirable to have control of which of a plurality of light sources of an illuminated textile are illuminated, as well as control of one or more lighting properties of one or more of the light sources. For example, it may be desirable to control color, color temperature, intensity, beam width, and/or direction of light output provided by one or more LED-based light sources. Control of illuminated textiles may be achieved using external devices such as mobile devices (e.g., remotes, smart phones, tablet computers). However, it is also desirable to control light output from illuminated textiles without an external computing device, in a manner that is simple, intuitive and/or inexpensive.

Thus, there is a need in the art to provide illuminated textiles, methods, apparatus and systems that enable control of one or more properties of light emitted from illuminated textiles, and that optionally overcome one or more drawbacks of existing apparatus and/or methods.

SUMMARY

The present disclosure is directed to lighting control. More particularly, various inventive methods and apparatus (e.g., illuminated textiles) disclosed herein relate to selective illumination of a plurality of light sources of an illuminated textile based on a physical context of the illuminated textile. In various embodiments, selective illumination may include controlling which of the plurality of light sources are illuminated, as well as controlling one or more properties of light output from the plurality of light sources. For example, in some embodiments, data from one or more sensors embedded in or otherwise associated with an illuminated textile may be utilized to sense a physical context of the illuminated textile. Light sources of the illuminated textile may be selectively illuminated based on the sensed physical context data.

Generally, in one aspect, an illuminated textile may include a textile portion, a plurality of light-emitting diodes (LEDs) secured to the textile portion, one or more sensors configured to detect a physical context of the textile portion, and a controller configured to selectively illuminate the plurality of LEDs based on the physical context sensed by the one or more sensors.

In various embodiments, the one or more sensors may be configured to sense an orientation of at least a portion of the textile portion. In various versions, the controller may be configured to selectively illuminate the plurality of LEDs to emit light primarily from one region of the textile portion, based on the sensed orientation. In various versions, the controller may be further configured to adjust a property of light emitted from at least some of the plurality of LEDs based on the sensed orientation. In various versions, the one or more sensors may be a gyroscope.

In various embodiments, the one or more sensors may be configured to sense a strain placed on the textile portion, and the controller may be configured to selectively illuminate the plurality of LEDs based on the sensed strain. In various versions, the controller may be configured to adjust a property of light emitted from at least some of the plurality of LEDs based the sensed strain. In various versions, the controller may be configured to adjust an intensity of the light emitted from at least some of the plurality of LEDs in proportion to the sensed strain. In various versions, the one or more sensors may include a strain gauge.

In various embodiments, the one or more sensors may include a plurality of proximity sensors secured to the textile portion and configured to sense proximity to each other. The controller may be configured to selectively illuminate the plurality of LEDs based on the sensed proximity. In various versions, the controller may be further configured to selectively illuminate at least some of the plurality of LEDs at an intensity in proportion to the sensed proximity.

In various embodiments, the one or more sensors may include at least one sensor configured to sense a position of the textile portion relative to a runner. The controller may be configured to selectively illuminate the plurality of LEDs based on the sensed position of the textile portion relative to the runner. In various versions, the at least one sensor may be a magnetic sensor.

In various embodiments, the one or more sensors may be configured to sense a twist in the textile portion. The controller may be configured to selectively illuminate the plurality of LEDs based on the sensed twist in the textile portion. In various versions, the controller may be configured to illuminate LEDs of the plurality of LEDs that lay near an exterior of the sensed twist of the textile portion with a different intensity than LEDs that lay near an interior of the sensed twist. In various versions, the controller may be configured to illuminate at least some of the plurality of LEDs at an intensity in proportion to a sensed tightness of the sensed twist.

In various embodiments, the one or more sensors may be configured to sense a pinch in the textile portion. The controller may be configured to selectively illuminate the plurality of LEDs based on the sensed pinch. In various versions, the controller may be configured to illuminate a subset of LEDs of the plurality of LEDs based on a location of the sensed pinch in the textile portion. In various versions, the controller may be configured to adjust a property of light emitted from at least some of the plurality of LEDs based on a location of the sensed pinch or a location of a sensed second pinch in the textile portion. In various versions, the controller may be configured to adjust a property of light emitted from at least some of the plurality of LEDs based on a force of the sensed pinch in the textile portion.

In various embodiments, the textile portion may include shape memory material having a nominal shape. The controller may be configured to selectively illuminate the plurality of LEDs based on a deformation in the textile portion from the nominal shape that is sensed by the one or more sensors.

In various embodiments, the one or more sensors may be configured to sense a motion of the textile portion. The controller may be configured to selectively illuminate the plurality of LEDs based on the sensed motion. In various versions, the controller may be configured to selectively illuminate the plurality of LEDs to ripple light through the plurality of LEDs with a intensity that corresponds to an intensity of the sensed motion.

In various embodiments. the one or more sensors may include at least one camera embedded in the textile portion and configured to sense motion of the textile portion or physical presence near the textile portion.

In another aspect, a method of illuminating a plurality of light sources distributed across a textile may include sensing, by one or more sensors embedded in the textile, a physical context of the textile portion, and selectively illuminating the plurality of light sources based on the physical context sensed by the one or more sensors.

In various embodiments, the sensing may include sensing, by the one or more sensors, an orientation of at least a portion of the textile. In various versions, the selectively illuminating may include selectively illuminating the plurality of light sources to emit light primarily from one region of the textile portion, based on a sensed orientation, or adjusting a property of light emitted from at least some of the plurality of light sources based on a sensed orientation.

In various embodiments, the sensing may include sensing, by the one or more sensors, a strain placed on the textile. In various versions, the selectively illuminating may include adjusting a property of light emitted from at least some of the plurality of light sources based on the sensed strain.

In various embodiments, the one or more sensors may include a plurality of proximity sensors. In various versions, the sensing may include sensing, by the plurality of proximity sensors, proximity of two or more of the plurality of proximity sensors to each other. In various versions, the selectively illuminating may include selectively illuminating the plurality of light sources based on the sensed proximity of the two or more of the plurality of proximity sensors to each other.

In another aspect, an illuminated textile system may include an illuminated textile, a camera configured to observe a physical context of the illuminated textile, and a controller configured to selectively illuminate the illuminated textile based on the physical context observed by the camera. In various embodiments, the camera may be an infrared camera. In various embodiments, the camera may be configured to detect changes in position of one or more points on the illuminated textile. In various versions, the controller may be configured to perform the selective illumination based on the detected changes in position.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware or with an application on multifunctional hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

As used herein, the term "illuminated textile" refers to a textile that includes a plurality of integrated light sources such as LEDs, or that is illuminated by an external light source such as an ultraviolet light. A "textile" may be any type of flexible material that is constructed with weaves or other patterns of component materials (e.g., threads), and may include but is not limited to fabric constructed of various materials, chainmail, materials created by a three-dimensional printer, and so forth. In some examples, the light sources may be coupled into a textile and out again using, e.g., optic fibers. In other examples, light sources such as LEDs may be embedded into or on a textile using conductive thread or glue. In addition to or instead of integrating light sources into the textile, in some instances, light may be projected onto a textile, e.g., as visible light or ultraviolet light (e.g., to illuminate a fluorescent textile). Illuminated textiles may have weaves of various sizes, from large open weaves such as might be found in nets, to fine weaves that may be found in curtains or other types of textiles. Illuminated textiles also are not limited to two-dimensional planes. In some embodiments, illuminated textiles may also occupy three dimensions.

As used herein, a "physical context" of an illuminated textile may refer to a physical arrangement or condition of the illuminated textile, such as it being bunched up, spread out, crammed, folded, rolled, twisted, squeezed, altered from a nominal shape, or to the illuminated textile's orientation (e.g., vertical, horizontal, and/or somewhere in between). Physical context may additionally or alternatively refer to a manner in which the illuminated textile is interacting with another illuminated textile or its surroundings. Physical context may additionally or alternatively refer to any forces that have acted or are currently acting on the illuminated textile, such as it being moved, pulled, pushed, pressed, shaken, waved, flapped, moistened, heated, cooled, and so forth.

As used herein, "selective illumination" may refer to selecting which of a plurality of light sources of an illuminated textile are illuminated. Additionally or alternatively, it may refer to controlling one or more properties of light emitted from the plurality of light sources, including but not limited to brightness, saturation, hue, temperature, effects (e.g., blinking, animation, etc.) and so forth.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Light sources such as LEDs may be integrated with textiles to create so-called "illuminated textiles." Illuminated textiles may be used for various purposes. In an architectural context such as in a retail space or an office, illuminated textiles may be used as, e.g., spaced dividers, wall coverings or curtains that also function to illuminate nearby surroundings. It is desirable to have control over one or more light sources of the illuminated textile, as well as lighting properties of those light sources. Selective illumination of an illuminated textile may be achieved using external devices such as smart phones. However, it is also desirable to be able to selectively illuminate textiles without using an external computing device, in a manner that is simple, intuitive and/or inexpensive.

Thus, Applicants have recognized and appreciated that it would be beneficial to provide illuminated textiles, methods, apparatus and systems that enable selective illumination of light sources associated with illuminated textiles based on physical contexts of the textiles, and that optionally overcome one or more drawbacks of existing apparatus and/or methods.

Figure 1:
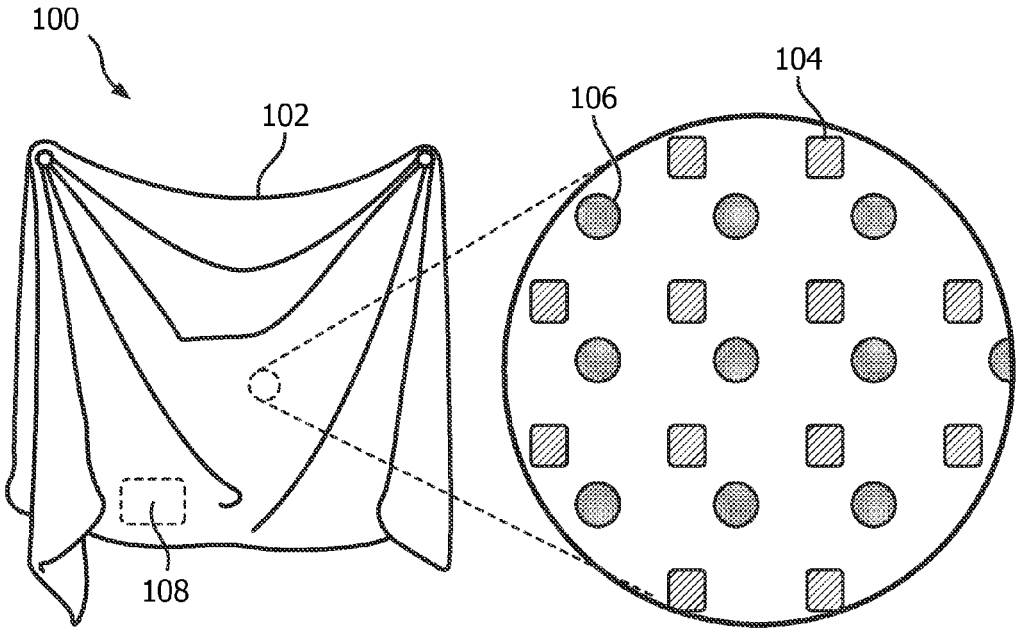
FIG. 1 illustrates example components of an illuminated textile configured to be selectively illuminated, in accordance with various embodiments.

Referring to FIG. 1, an illuminated textile 100 configured with selected aspects of the present disclosure may include a textile portion 102, one or more sensors 104, and a plurality of light sources 106. In various embodiments, one or more sensors 104 and/or plurality of light sources 106 may be evenly spaced across textile portion 102 (e.g., as a mesh), as depicted in FIG. 1, or may be otherwise spaced. In various embodiments, textile portion 102 may be any type of textile woven or otherwise constructed with natural or synthetic raw materials, including but not limited to cotton, nylon, polypropylene, rubber, silk, polyester, metal links, and so forth. Textile portion 102 also may be of any size or shape, depending on the application.

One or more sensors 104 may be configured to detect various aspects of a physical context of textile portion 102. As described above, a "physical context" of textile portion 102 may include its physical arrangement or configuration and/or one or more forces that have acted upon or that are acting upon textile portion 102. As will be discussed in more detail with reference to the various figures, one or more sensors 104 may include various types of sensors, including but not limited to a plurality of proximity sensors (e.g., radio-based, such as RFID or NFC), one or more gyroscopes to detect orientation, one or more cameras external to or embedded within textile portion 102 (e.g., to detect proximity of something to textile portion 102), one or more strain gauges, one or more magnetic sensors, one or more presence sensors, one or more light sensors, one or more motion sensors (e.g., accelerometers), one or more capacitive touch sensors, one or more moisture detectors, and so forth. In various embodiments, different types of sensors may be used in combination to triangulate data sets to provide improved accuracy and/or to enhance a number of functions and features available.

Plurality of light sources 106 may include one or more types of light sources, including but not limited to incandescent lights and/or LEDs. In some embodiments where LEDs are employed, each LED may be integrated with a sensor of one or more sensors 104.

In various embodiments, a controller 108 may be separate from or embedded in illuminated textile 100. Controller 108 may be implemented using any combination of hardware and software, and may be in communication with one or more sensors 104 and plurality of light sources 106, e.g., using various wireless and/or wired technologies (e.g., conductive threads). In various embodiments, controller 108 may be configured to selectively illuminate plurality of light sources 106 based on a physical context of textile portion 102 sensed by one or more sensors 104.

Figure 2:
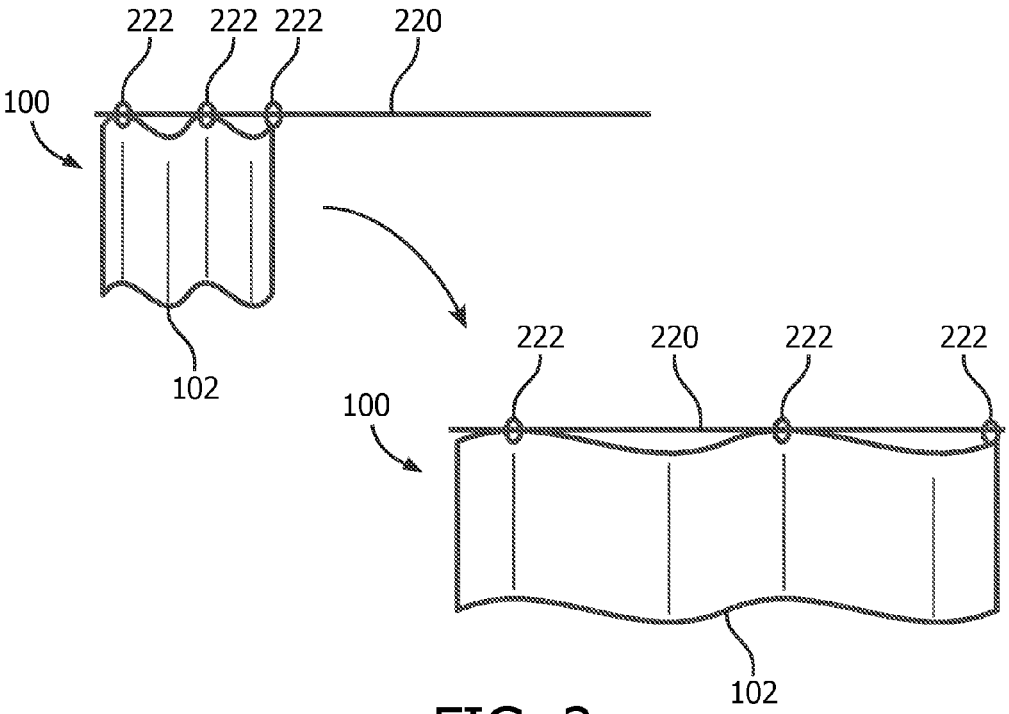
FIG. 2 illustrates an example illuminated textile configured to be selectively illuminated in response to being bunched, extended, stretched and/or pulled, in accordance with various embodiments.

Referring to FIG. 2, in various embodiments, the one or more sensors 104 (see FIG. 1) may be configured to sense to what degree textile portion 102 is "bunched up" or extended, so that controller 108 (see FIG. 1) may selectively illuminate plurality of light sources 106 accordingly. For example, on the upper left side of FIG. 2, textile portion 102 is shifted mostly towards the left side of a ceiling runner 220. On the lower right side of FIG. 2, textile portion 102 is extended across most of ceiling runner 220. In FIG. 2 and other embodiments described herein, textile portion 102 may be movably secured to ceiling runner 220 using a plurality of curtain rings 222. However, the method of securing textile portion 102 to ceiling runner 220 or any other feature is not material, and it should be understood that any securing means may be used.

In various embodiments, one or more sensors 104 may include a plurality of proximity sensors secured to or embedded in textile portion 102 and configured to sense proximity to each other. Controller 108 may be configured to selectively illuminate the plurality of light sources 106 (see FIG. 1) based on a sensed proximity of two or more of the plurality of proximity sensors to each other. In the context of FIG. 2, the plurality of proximity sensors may detect when textile portion 102 is bunched up, as depicted on the upper left, because the proximity sensors may be closer to one another. Likewise, the proximity sensors may detect when textile portion 102 is spread out/extended, as depicted on the lower right, because the proximity sensors may be spread farther apart.

In some embodiments, controller 108 may be configured to selectively illuminate plurality of light sources 106 at an intensity in proportion to the sensed proximity. Thus, for instance, as textile portion 102 in FIG. 2 is extended farther across ceiling runner 220, controller 108 may illuminate some or all of plurality of light sources 106 with an intensity that is proportionate to the degree of extension of textile portion 102.

Assume, for instance, that textile portion 102 shown in FIG. 2 is used in a hospital as a separator between beds in an intensive care unit (ICU). Textile portion 102 may, by default, be bunched up as shown on the upper left, and plurality of light sources 106 may collectively emit little or no light. When a doctor or nurse visits the patient, however, they may extend textile portion 102 across ceiling runner 220, e.g., to afford some degree of privacy. The plurality of proximity sensors may sense that they have been moved farther apart. In response, controller 108 may increase an intensity of light emitted from plurality of light sources 106, which may provide the doctor or nurse with more light to examine the patient.

In some embodiments, the rate at which textile portion 102 is extended may also affect how light is emitted. For instance, if textile portion 102 is extended relatively quickly, controller 108 may selectively illuminate plurality of light sources 106 to emit more light (e.g., with a higher intensity) than if textile portion 102 is extended relatively slowly.

The extent which textile portion 102 is extended may be measured using other means besides proximity sensors embedded in textile portion 102. For example, in some embodiments, one or more sensors may be configured to sense a position of textile portion 102 relative to ceiling runner 220. Controller 108 in turn may be configured to selectively illuminate plurality of light sources 106 based on a sensed position of textile portion 102 relative to ceiling runner 220. For instance, the farther textile portion 102 in FIG. 2 is extended across ceiling runner 220, the more (or less) of plurality of light sources 106 may be illuminated. Additionally or alternatively, the farther textile portion 102 in FIG. 2 is extended across ceiling runner 220, selected individual light sources may be illuminated more (or less) intensely. In various embodiments, a proximity sensor, a magnetic sensor or another type of sensor may be employed to sense a position of textile portion 102 relative to ceiling runner 220. Although ceiling runners are referred to herein as examples, this is not meant to be limiting, and any other type of generic runner or other mechanism for extending/retracting an illuminated textile may be used instead.

Textile portion 102 of FIG. 2 may additionally or alternatively be acted upon in other ways to affect one or more properties of light emitted from illuminated textile 100. For instance, a user may tug or pull on an edge of textile portion 102. One or more sensors 104 may include a strain gauge or other similar sensor configured to sense this tug or pull. Based on such a sensed pull or tug, controller 108 may selectively illuminate plurality of light sources 106, e.g., by turning them on or off in response to a single brief tug, by dimming or brightening emitted light in response to a sustained pull, or by otherwise performing selective illumination. In some embodiments, one or more strain gauges may be embedded throughout textile portion 102. In some embodiments, strain gauges may be incorporated with other parts of illuminated textile 100, e.g., in between ceiling runner 220 and textile portion 102 (e.g., in curtain rings 222).

Figure 3:
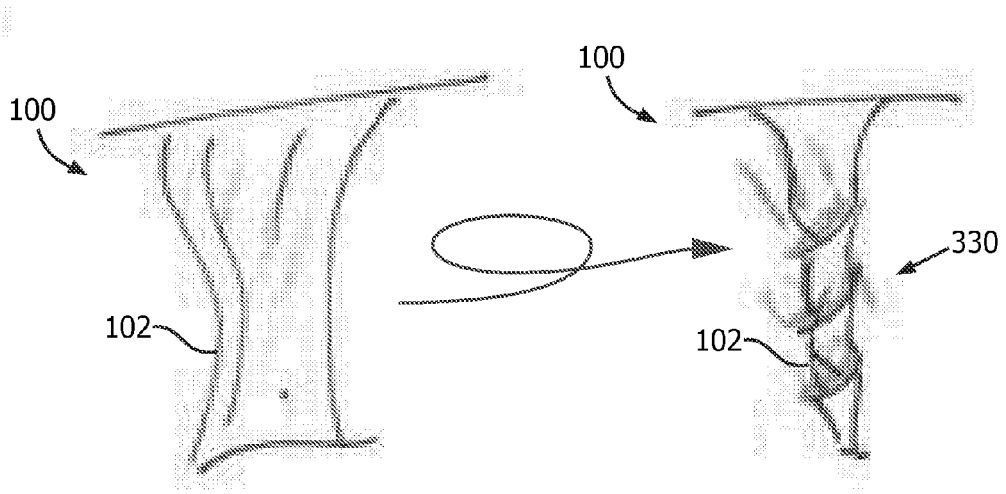
FIG. 3 illustrates an example illuminated textile configured to be selectively illuminated in response to being twisted, in accordance with various embodiments.

FIG. 3 depicts an example in which textile portion 102 is arranged into at least one twist 330. One or more sensors 104 (see FIG. 1) may include proximity sensors and/or other types of sensors, such as strain gauges, that may be configured to sense when a twist 330 is formed in textile portion 102. In various embodiments, controller 108 (see FIG. 1) may be configured to selectively illuminate plurality of light sources 106 (see FIG. 1) based on the sensed twist 330. For example, controller 108 may be configured to illuminate LEDs of a plurality of LEDs that lay near an exterior of a sensed twist 330 of textile portion 330 with a different (e.g., higher) intensity than LEDs that lay near an interior of the sensed twist 330. Additionally or alternatively, in some embodiments, controller 108 may be configured to illuminate at least some of the plurality of LEDs with an intensity that is proportionate to a sensed tightness of the sensed twist 330.

In some embodiments, textile portion 102 may be twisted to be used in a manner similar to a floor standing luminaire. In some embodiments, when textile portion 102 is completely untwisted, as shown on the left, illuminated textile 100 may emit light at a very low intensity (e.g., a gentle glow), or not at all. By contrast, when textile portion 102 includes a twist 330, illuminated textile 100 may emit relatively more light.

Twist 330 may be held in place using various devices and techniques, including but not limited to clips, hook and loop fasteners (e.g., Velcro), and so forth. In some embodiments, wire or other malleable material may be integrated into textile portion 102 so that when twist 330 is introduced, it is retained by the wire or other malleable material.

Figure 4:
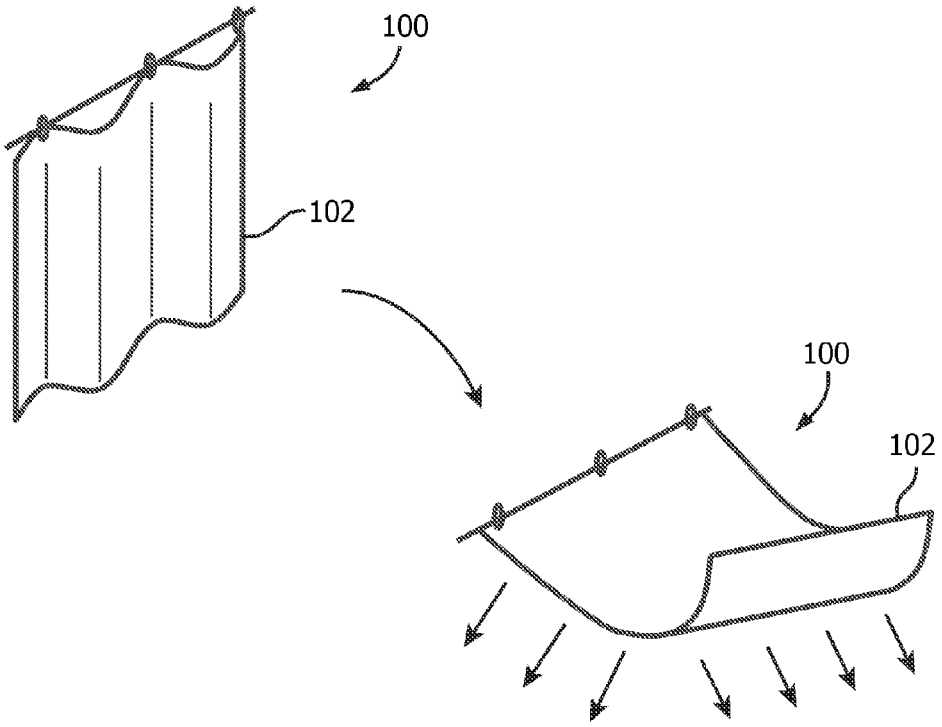
FIG. 4 illustrates an example illuminated textile configured to be selectively illuminated in response to being reoriented, in accordance with various embodiments.

FIG. 4 depicts another example illuminated textile 100. In various embodiments, one or more sensors 104 (see FIG. 1) may include one or more gyroscopes (e.g., spread across textile portion 102) that are configured to sense orientation of textile portion 102. In other embodiments, other sensors such as proximity sensors could be used in addition to or instead of one or more gyroscopes to sense an orientation of all or a portion of textile portion 102.

In some embodiments, controller 108 (see FIG. 1) may be configured to adjust a property of light emitted from at least some of plurality of light sources 106 (see FIG. 1) based on an orientation sensed by one or more gyroscopes or other sensors. For example, if hanging vertically (e.g., perpendicular to the ground), illuminated textile 100 may emit no light or soft ambient lighting. If hanging horizontally, on the other hand, illuminated textile 100 may emit stronger or harsher light, and/or light of a particular hue.

In various embodiments, controller 108 may be configured to selectively illuminate plurality of light sources 106 to emit light primarily from one region of textile portion 102, such as one side of textile portion 102, based on the sensed orientation. For instance, assume illuminated textile 100 is hanging vertically, as shown on the upper left in FIG. 4. When a user requires more lighting, she may lift one end of textile portion 102 so that textile portion 102 is no longer perpendicular to the ground, as shown on the lower right in FIG. 4. In response, controller 108 may selectively illuminate plurality of light sources 106 so that light is emitted from what is now the underside of textile portion 102. Softer light (e.g., colored ambient lighting), or no light, may be emitted from the opposite side of textile portion 102 that faces the ceiling.

In some embodiments, controller 108 may illuminate one or more of plurality of light sources 106 at an intensity that is in proportion to a degree of orientation of textile portion 102. For instance, the higher textile portion 102 is lifted (i.e. the closer it is to being parallel to the ground), the brighter the light that is emitted. If less bright light is desired, the user may lower textile portion 102 to an intermediate angle such that textile portion 102 is in between perpendicular and parallel to the ground.

In various embodiments, when textile portion 102 is at a particular angle, a user may interact with it in other ways to affect how illuminated textile 100 emits light. For instance, in some embodiments, a user may press or pull a horizontally-oriented fabric, from above or below. Sensors near where the user pressed or pulled (e.g., capacitive touch sensors, proximity sensors, accelerometers, etc.) may sense the pressing/pulling. Controller 108 may alter one or more properties of light emitted from light sources in the area. In some cases, if illuminated textile 100 is on the ground or draped over something, a user may walk, sit or lay on it to cause changes in how it emits light.

In various embodiments, textile portion 102 may have multiple regions oriented at varying angles. For instance, one region of textile portion 102 may be oriented at one angle (e.g., horizontally) and another region of textile portion 102 may be oriented at another angle (e.g., vertically). One or more sensors 104 may be configured to sense this varied orientation between the regions. Controller 108 may be configured to selectively illuminate light sources in each region of textile portion 102 independently, in a manner appropriate for that region's orientation.

Figure 5:
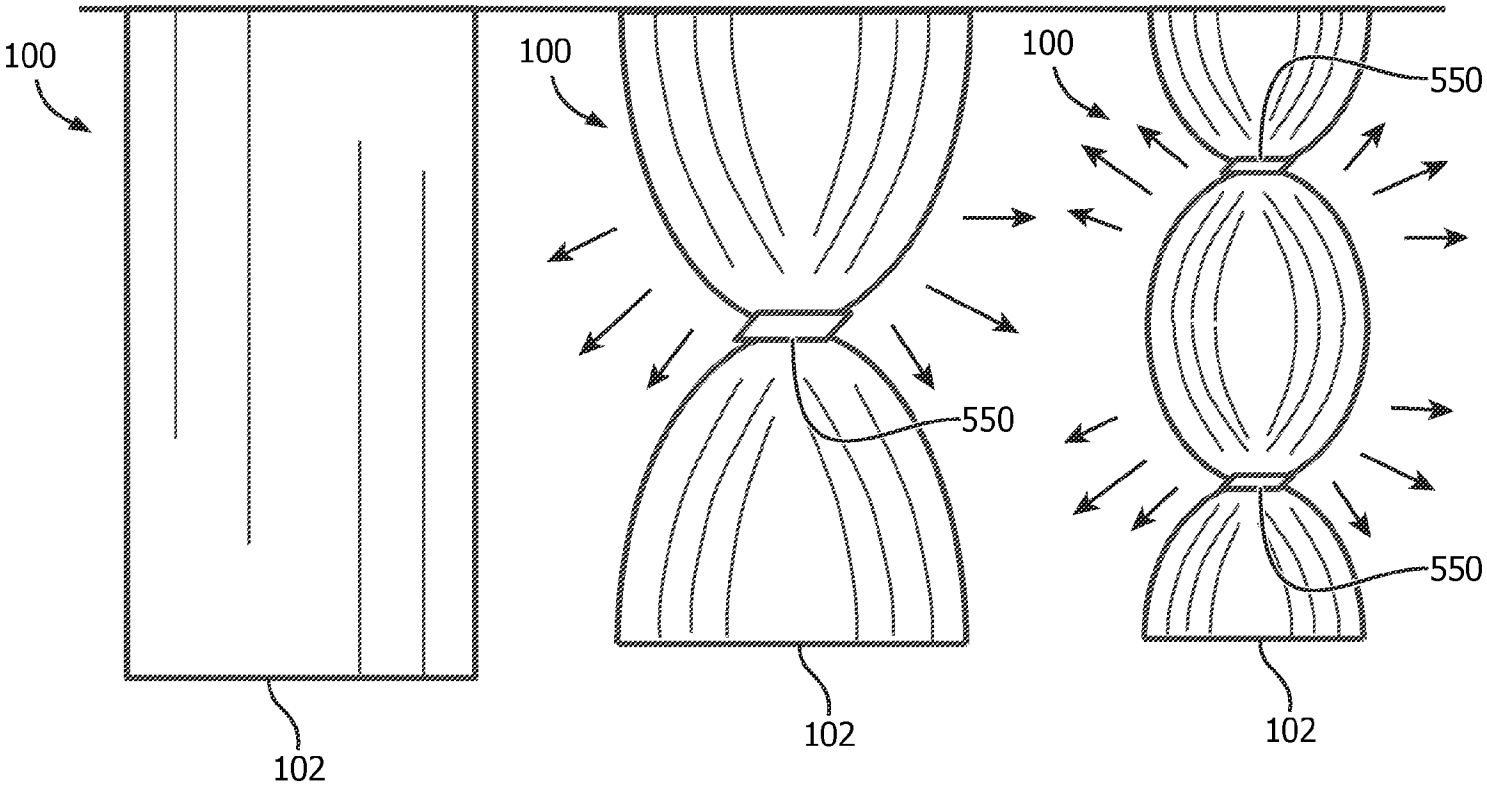
FIG. 5 illustrates an example illuminated textile configured to be selectively illuminated in response to being pinched, in accordance with various embodiments.

FIG. 5 depicts another example in which one or more sensors 104 (see FIG. 1) of illuminated textile 100 are configured to sense one or more "pinches" 550 in textile portion 102. To sense pinches, one or more sensors 104 (see FIG. 1) may include proximity sensors or other types of sensors. In various embodiments, pinches 550 may be created and/or held in place using various fasteners or other means, such as Velcro. In various embodiments, controller 108 (see FIG. 1) may be configured to selectively illuminate plurality of light sources 106 (see FIG. 1) based on a sensed pinch 550 in textile portion 102.

In various embodiments, controller 108 may be configured to illuminate a subset of light sources of plurality of light sources 106 based on a location or force of the sensed pinch 550 in the textile portion 102. For example, in the center illuminated textile 100 of FIG. 5, textile portion 102 is pinched in its middle. In response to this particular pinch 550 being sensed at that particular location, controller 108 may selectively illuminate plurality of light sources 106 so that, e.g., light is emitted primarily or exclusively from an underside of a "bulge" in textile portion 102 immediately above the sensed pinch 550. This may provide light towards the floor, which may be useful to a user nearby attempting to perform a task. In other embodiments, the same pinch 550 at the same location may result in light being emitted in other directions, or may result in emitted light having various properties (e.g., intensity, hue, saturation, temperature, etc.).

Moving the pinch up or down may cause changes in one or more properties of light emitted from illuminated textile 100. For example, if the pinch 550 is located near the top of textile portion 102, in some embodiments, light output may be focused towards the ceiling. If the pinch 550 is located near the bottom, in some embodiments, light may be directed so that it "spills" through textile portion 102 onto the floor and/or provides low level lighting.

In various embodiments, a number of sensed pinches 550 may also affect how controller 108 selectively illuminates plurality of light sources 106. For instance, on the right side of FIG. 5, two pinches 550 are formed in textile portion 102. Controller 108 may be configured to adjust a property of light emitted from at least some of plurality of light sources 106 based on a number of the multiple sensed pinches in textile portion 102. For example, a first pinch 550 may cause controller 108 to selectively illuminate plurality of light sources 106 in a particular direction, and a second pinch 550 may alter a hue, temperature, saturation, intensity or other property of the emitted light.

In some embodiments, both number of pinches 550 and their locations may affect how controller 108 selectively illuminates plurality of light sources 106. For instance, on the right in FIG. 5, light is emitted from the top and bottom of the "bulge" between the two sensed pinches 550. Altering the locations of the pinches 550 and/or their numbers may cause one or more properties of emitted light to be altered. If the pinches 550 are moved closer together, the middle "bulge" may emit light more intensely, or at a different color. If the pinches 550 are moved farther apart, the middle "bulge" may emit light less intensely or at a different color. In some cases, the portions of textile portion 102 above and below the middle "bulge" may also be selectively illuminated, e.g., based on the locations and/or number of sensed pinches.

Figure 6:
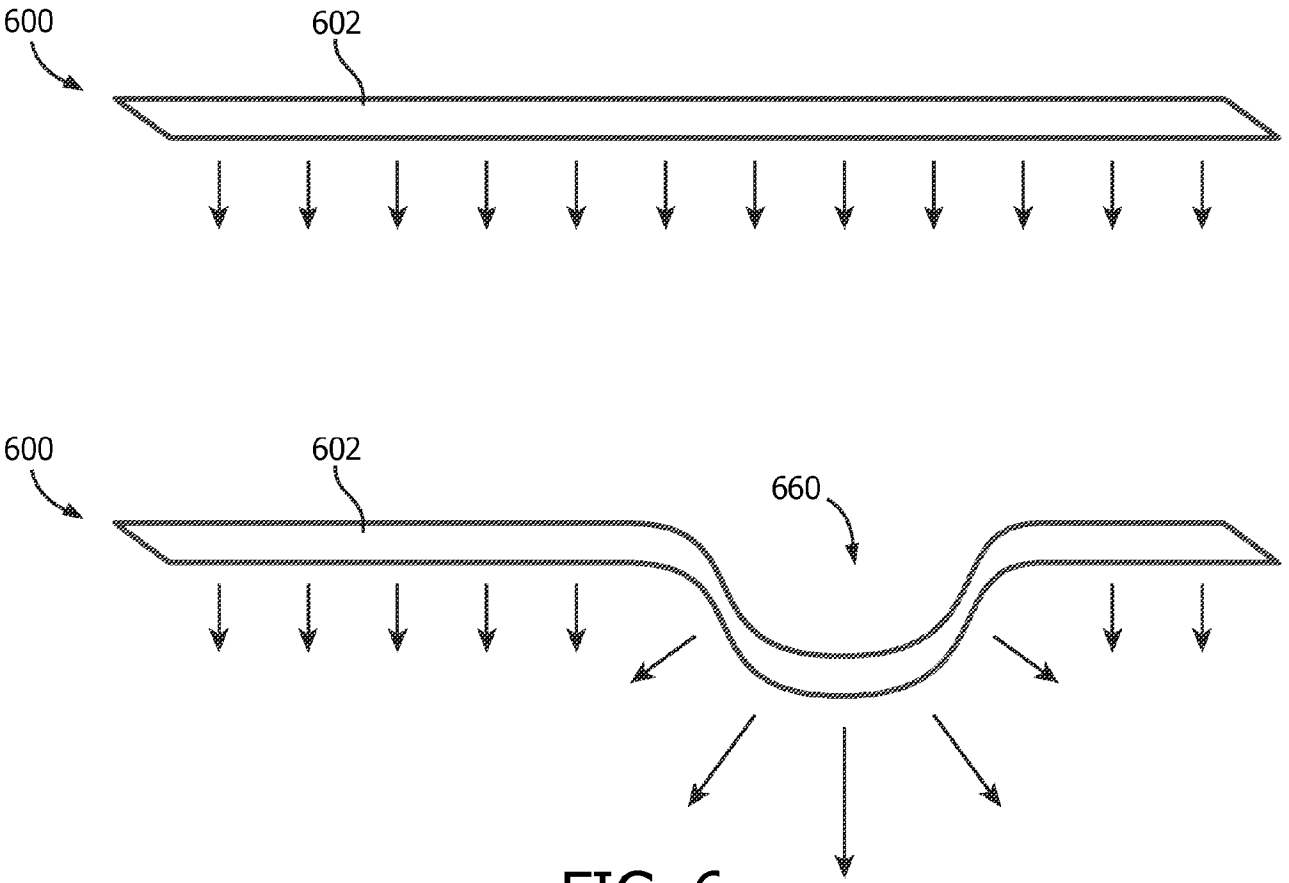
FIG. 6 illustrates an example shape memory illuminated textile configured to be selectively illuminated in response to being reshaped, in accordance with various embodiments.

FIG. 6 depicts an alternatively embodiment in which an illuminated textile 600 has a textile portion 602 formed from a shape memory material. In various embodiments, textile portion 602 may have a nominal shape (e.g., flat, as shown at the top of FIG. 6). One or more sensors 104 (see FIG. 1) may be configured to detect any deformation of textile portion 602 from its nominal shape. For example, one or more proximity sensors or strain gauges may be deployed to sense changes from the nominal shape of textile portion 602. Controller 108 (see FIG. 1) may be configured to selectively illuminate the plurality of light sources 106 (see FIG. 1) based on a sensed deformation.

For instance, as shown at the bottom of FIG. 6, a user who desires more task lighting may pull down on textile portion 602 to form a "trough" 660. Controller 108 may selectively illuminate light sources in the area forming trough 660 so that emitted light has one or more properties that are different from light emitted from other areas of textile portion 602 that have not been deformed. Thus, for instance, the light emitted from light sources near trough 660 may be more intense than light emitted from light sources in other areas of textile portion 602 (as indicated by the arrows), which may give the user the task lighting she desires.

One example of where such an embodiment may be useful is a shared space such as a long table at a library. Textile portion 602 may extend hang above and along the length of the long library table. Library patrons may sit down and manipulate textile portion 602, e.g., by forming troughs 660 at their seating location, so that they are able to study without affecting lighting at other positions along the table.

In various embodiments, other physical contexts of illuminated textile 100 (or 600) may be sensed and used to dictate how plurality of light sources 106 is selectively illuminated. In some embodiments, one or more sensors 104 may be configured to sense motion in all or a portion of textile portion 102. For example, one or more sensors 104 may include motion sensors, such as accelerometers, configured to detect when all or a portion of textile portion 102 is shaken. Controller 108 may be configured to selectively illuminate plurality of light sources 106 based on the sensed motion. For instance, controller 108 may be configured to selectively illuminate plurality of light sources 106 to, e.g., ripple light through plurality of light sources 106. In some embodiments, a shake on one side of textile portion 102 may cause light to "ripple" through plurality of light sources 106 to the other side of textile portion 102. In some instances, light may continue to be emitted out of the other side of textile portion 102, e.g., so that the other side appears to now have "more" light.

In some embodiments, light may ripple through plurality of light sources 106 with an intensity that corresponds to an intensity of sensed motion such as sensed shaking. Thus, a slow wave of textile portion 102 may cause light ripples to slowly sway through plurality of light sources 106. On the other hand, a harsher shake of textile portion 102 may cause harsher light ripples to pass through plurality of light sources 106.

In other embodiments, one or more sensors 104 may include one or more capacitive touch sensors configured to detect physical contact with textile portion 102, e.g., by a user's finger. If a user desires that a certain portion of illuminated textile 100 emit light with a particular property, she may run her hand across that portion. This touch may be sensed by capacitive touch sensors at that location. Controller 108 may then selectively illuminate plurality of light sources 106 so that light sources at or near the touched location emit light with the desired property (e.g., more brightness, particular hue/temperature, etc.).

In some embodiments, the user's touch may be sensed by a combination of one or more capacitive touch sensors and one or more strain gauges. These sensors may be used to determine the force of the touch, which in turn may dictate one or more properties of light emitted by illuminated textile 100, such as color, intensity, saturation, temperature, etc. For instance, a light touch with one finger may result in one soft glow from one or more light sources. A sharp prod from the finger, by contrast, may result in a bright glaring spot on illuminated textile 100. In some embodiments, the duration of the touch, a motion of the touch and/or a pressure of the touch may also drive selective illumination.

Other types of physical contexts may be sensed by one or more sensors 104 and may cause controller 108 to selectively illuminate plurality of light sources 106 in a variety of ways. These other types of physical contexts include but are not limited to textile portion 102 being stretched, folded, creased, pushed, tugged, prodded, dropped, unfolded, pressed, and so forth. In addition, in some embodiments, multiple illuminated textiles may perform cooperative selective illumination.

Figure 7:
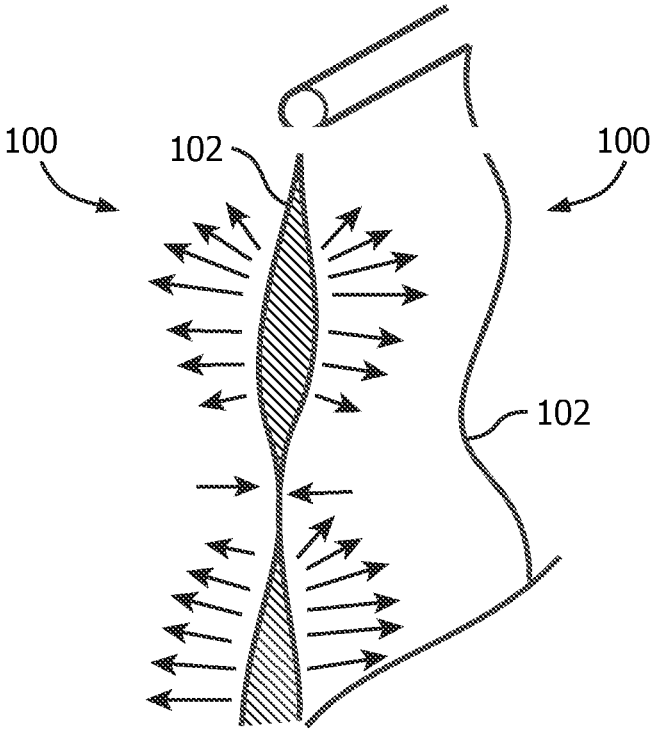
FIG. 7 illustrates an example of multiple illuminated textiles selectively emitting light based on interactions with each other, in accordance with various embodiments.

For instance, and as shown in FIG. 7, textile portions 102 of two or more illuminated textiles 100 may be pulled apart, e.g., to cause light sources on their inner-facing surfaces to emit light. If pulled closer together, light sources on the textile portions' out surfaces may emit light instead. In other embodiments, the opposite may be true. In other examples, two or more illuminated textiles 100 may be partially or fully overlapped, folded with each other, lined up with each other, arranged perpendicular to each other, squeezed together, and so forth. Any of these interactions may be sensed by one or more sensors 104 to cause a controller 108 of one or both textiles to selectively illuminate plurality of light sources 106 on one or both textiles in any number of ways.

In yet other embodiments, one or more sensors 104 may include one or more cameras configured to detect when an object such as a person is present nearby. In some instances, multiple small cameras may be embedded in textile portion 102 and may face in a particular direction, e.g., to provide motion sensing. In other embodiments, the cameras may be external to textile portion 102, and may be configured to look for particular codes, symbols, indicia or patterns contained on textile portion that denote position or setting of textile portion 102. In some embodiments, the cameras may be infrared cameras, so that the searched-for symbols, indicia codes and/or patterns may be invisible to the human eye.

Figure 8:
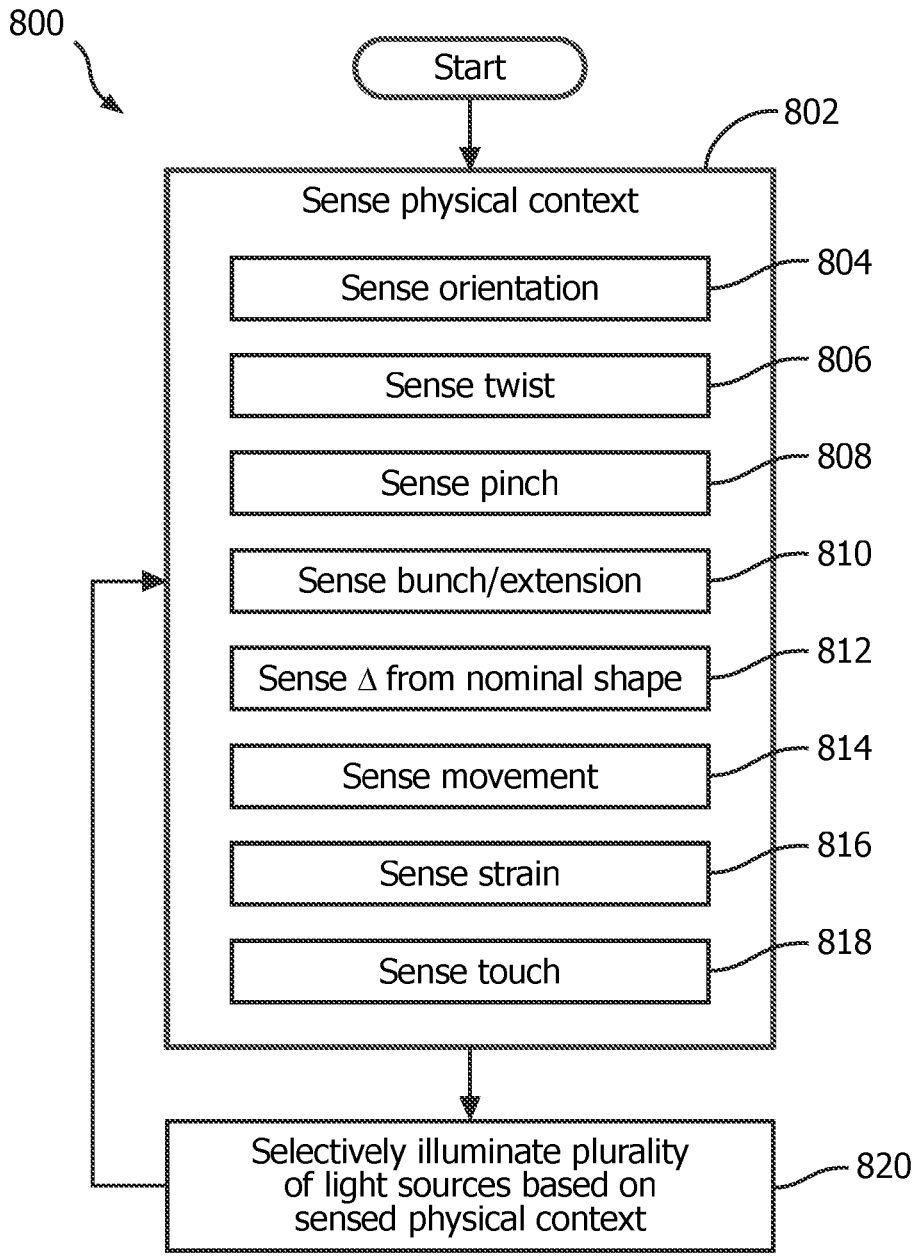
FIG. 8 depicts an example method, in accordance with various embodiments.

FIG. 8 depicts an example method 800 that may be implemented by various components of illuminated textile 100 (or 600), in accordance with various embodiments. While the operations or shown in a particular order, this is not meant to be limiting, as the order of operations is arbitrary. Additionally, various operations may be added or omitted without departing from the present disclosure.

At block 802, illuminated textile 100 may sense a physical context of textile portion 102, e.g., using one or more sensors 104. In various embodiments, block 802 may include sensing an orientation of textile portion 102 using, e.g., one or more gyroscopes embedded in or separate from textile portion 102 (block 804). Additionally or alternatively, block 802 may include sensing one or more twists in textile portion 102 using, e.g., one or more proximity sensors and/or strain gauges (block 806). Additionally or alternatively, block 802 may include sensing one or more pinches in textile portion 102 using, e.g., one or more proximity sensors or strain gauges (block 808). Additionally or alternatively, block 802 may include sensing whether textile portion 102 has been bunched (e.g., as shown on the upper left in FIG. 2) or is extended (e.g., as shown on the lower right in FIG. 2) using, e.g., one or more proximity sensors, strain gauges, and so forth (block 810).

Additionally or alternatively, in cases where textile portion 102 includes shape memory material, block 802 may include sensing whether textile portion 102 has been deformed from a nominal shape using, e.g., one or more proximity or strain sensors (block 812). Additionally or alternatively, block 802 may include sensing movement of textile portion 102 using, e.g., one or more accelerometers (block 814). Additionally or alternatively, block 802 may include sensing strain in textile portion 102 using, e.g., one or more strain gauges embedded in textile portion 102 (block 816). Additionally or alternatively, block 802 may include sensing whether textile portion 102 has been touched using, e.g., one or more capacitive touch sensors (block 818).

At block 820, one or more sensed aspects of the physical context of textile portion 102 may be used, e.g., by controller 108, to selectively illuminate plurality of light sources 106.

Although illuminated textiles are described herein, disclosed techniques may be implemented with textiles to cause them to provide other types of output than light. For example, a textile may include one or more audio speakers (e.g., embedded), which may be configured to selectively output various sounds in response to a sensed physical context of the textile.

As another example, a textile may include multiple olfactory output devices configured to emit various smells in response to a sensed physical context. For instance, one or more sensors 104 may include one or more moisture detectors, and on detection of moisture (e.g., due to incontinence), the olfactory sensors may emit air freshening agent. In some cases, in addition to or instead of olfactory output, controller 108 may selectively illuminate illuminated textile 100 in response to moisture detected by one or more sensors 104, e.g., to notify a nurse that an elderly or infirmed patient has had an "accident."

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An illuminated textile, comprising:

a textile portion;

a plurality of light-emitting diodes (LEDs) secured to, and integral with, the textile portion;

one or more sensors configured to detect one or more changes to a shape or orientation of the textile portion; and a controller configured to selectively illuminate the plurality of LEDs integral with the textile portion based on one or more signals provided by the one or more sensors to emit light having a selected lighting property that is proportional to the one or more signals.

2. The illuminated textile of claim 1, wherein the one or more sensors are configured to sense an orientation of at least a portion of the textile portion.

3. The illuminated textile of claim 2, wherein the controller is configured to selectively illuminate the plurality of LEDs to emit light primarily from one region of the textile portion, based on the sensed orientation.

4. The illuminated textile of claim 2, wherein the one or more sensors comprise a gyroscope.

5. The illuminated textile of claim 1, wherein the one or more sensors are configured to sense a strain placed on the textile portion, and the controller is configured to selectively illuminate the plurality of LEDs based on the sensed strain.

6. The illuminated textile of claim 5, wherein the one or more sensors comprise a strain gauge.

7. The illuminated textile of claim 1, wherein the one or more sensors include a plurality of proximity sensors secured to the textile portion and configured to sense proximity to each other, and the controller is configured to selectively illuminate the plurality of LEDs based on the sensed proximity.

8. The illuminated textile of claim 1, wherein the one or more sensors include at least one sensor configured to sense a position of the textile portion relative to a runner, and the controller is configured to selectively illuminate the plurality of LEDs based on the sensed position of the textile portion relative to the runner.

9. The illuminated textile of claim 8, wherein the at least one sensor is a magnetic sensor.

10. The illuminated textile of claim 1, wherein the one or more sensors are configured to sense a twist in the textile portion, and the controller is configured to selectively illuminate the plurality of LEDs based on the sensed twist in the textile portion.

11. The illuminated textile of claim 1, wherein the one or more sensors are configured to sense a pinch in the textile portion, and the controller is configured to selectively illuminate the plurality of LEDs based on the sensed pinch.

12. The illuminated textile of claim 1, wherein the textile portion comprises shape memory material having a nominal shape, and the controller is configured to selectively illuminate the plurality of LEDs based on a deformation in the textile portion from the nominal shape that is sensed by the one or more sensors.

13. The illuminated textile of claim 1, wherein the one or more sensors are configured to sense a motion of the textile portion, and the controller is configured to selectively illuminate the plurality of LEDs based on the sensed motion.

14. The illuminated textile of claim 1, wherein the one or more sensors comprises at least one camera embedded in the textile portion and configured to sense motion of the textile portion or physical presence near the textile portion.

15. A method of illuminating a plurality of light sources integral to a textile, comprising:

sensing, by one or more sensors embedded in the textile, a change in shape or orientation of the textile portion; and selectively illuminating the plurality of light sources based on one or more signals provided by the one or more sensors in response to the sensing to emit light having a selected lighting property that is proportional to the one or more signals.

16. The method of claim 15, wherein the sensing comprises sensing, by the one or more sensors, an orientation of at least a portion of the textile, and the selectively illuminating comprises:

selectively illuminating the plurality of light sources to emit light primarily from one region of the textile portion, based on a sensed orientation; or adjusting a property of light emitted from at least some of the plurality of light sources based on a sensed orientation.

17. The method of claim 15, wherein the sensing comprises sensing, by the one or more sensors, a strain placed on the textile, and the selectively illuminating comprises adjusting a property of light emitted from at least some of the plurality of light sources based on the sensed strain.

18. An illuminated textile system, comprising:

an illuminated textile comprising a plurality of embedded light sources;

a camera configured to observe one or more changes to a shape or orientation of the illuminated textile; and a controller configured to selectively illuminate one or more of the plurality of embedded light sources based on the physical context observed by the camera.

19. The illuminated textile system of claim 18, wherein the camera comprises an infrared camera.

20. The illuminated textile system of claim 13, wherein the camera is configured to detect changes in position of one or more points on the illuminated textile, and wherein the controller is configured to perform the selective illumination based on the detected changes in position.

* * * * *